US011217172B2

(12) United States Patent
Jiang et al.

(10) Patent No.: US 11,217,172 B2
(45) Date of Patent: Jan. 4, 2022

(54) PIXEL CIRCUIT, DRIVING METHOD THEREOF AND DISPLAY DEVICE

(71) Applicants: HEFEI BOE OPTOELECTRONICS TECHNOLOGY CO., LTD., Anhui (CN); BOE TECHNOLOGY GROUP CO., LTD., Beijing (CN)

(72) Inventors: Ran Jiang, Beijing (CN); Hai Kang, Beijing (CN); Donghui Wang, Beijing (CN); Yongquan Lu, Beijing (CN); Yunyun Zhang, Beijing (CN)

(73) Assignees: HEFEI BOE OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 13 days.

(21) Appl. No.: 16/622,637

(22) PCT Filed: May 31, 2019

(86) PCT No.: PCT/CN2019/089630
§ 371 (c)(1),
(2) Date: Dec. 13, 2019

(87) PCT Pub. No.: WO2019/228521
PCT Pub. Date: Dec. 5, 2019

(65) Prior Publication Data

US 2021/0142728 A1 May 13, 2021

(30) Foreign Application Priority Data

May 31, 2018 (CN) ..... 201810548349.7

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01); *G09G 2310/0272* (2013.01)

(58) Field of Classification Search
CPC .. G09G 3/3258; G09G 3/3266; G09G 3/3291; G09G 2310/0272
See application file for complete search history.

(56) References Cited

U.S. PATENT DOCUMENTS 8,902,138 B2 12/2014 Kim
9,148,930 B2 9/2015 Chung et al.
(Continued)

FOREIGN PATENT DOCUMENTS

CN 102842283 A 12/2012
CN 103514833 A 1/2014
(Continued)

OTHER PUBLICATIONS

First Office Action dated Aug. 20, 2019 for corresponding Chinese application 201810548349.7.
(Continued)

*Primary Examiner* — Roberto W Flores
(74) *Attorney, Agent, or Firm* — Nath, Goldberg & Meyer; Joshua B. Goldberg

(57) ABSTRACT

A pixel circuit and driving method thereof, a display device are provided, and the pixel circuit includes a switching sub-circuit, a threshold voltage extraction sub-circuit, an initialization sub-circuit, a feedback compensation sub-circuit, a driving transistor and a light emitting device. The threshold voltage extraction sub-circuit is coupled to a control electrode of the driving transistor, and configured to extract and store a threshold voltage of the driving transistor in response to an enable signal and configured to apply the threshold voltage and a data voltage written by the switching
(Continued)

sub-circuit to the control electrode of the driving transistor. The feedback compensation sub-circuit is coupled to a second terminal of the light emitting device and a data line, and configured to generate a data voltage compensation signal for a next display image frame according to an operating current of the light emitting device and supply it to the data line. (FIG. 1).

15 Claims, 2 Drawing Sheets

(56) References Cited

U.S. PATENT DOCUMENTS

| | | | | |
|---|---|---|---|---|
| 9,646,540 | B2 | 5/2017 | Kim | |
| 9,940,878 | B2 | 4/2018 | Liang | |
| 2011/0069094 | A1* | 3/2011 | Knapp | G09G 3/2003 345/690 |
| 2014/0326969 | A1 | 11/2014 | Kim | |
| 2015/0109278 | A1* | 4/2015 | Kim | G09G 3/3266 345/211 |
| 2015/0294626 | A1 | 10/2015 | Bi et al. | |
| 2016/0078808 | A1 | 3/2016 | Lin | |
| 2016/0125802 | A1 | 5/2016 | Lee et al. | |
| 2016/0210898 | A1 | 7/2016 | Tsuge et al. | |
| 2016/0267841 | A1* | 9/2016 | Yang | G09G 3/3258 |
| 2017/0061871 | A1* | 3/2017 | Xiang | G09G 3/3233 |
| 2017/0162125 | A1* | 6/2017 | Liang | G09G 3/3233 |
| 2018/0226022 | A1 | 8/2018 | Wu | |

FOREIGN PATENT DOCUMENTS

| | | | |
|---|---|---|---|
| CN | 103871356 | A | 6/2014 |
| CN | 104575374 | A | 4/2015 |
| CN | 105047137 | A | 11/2015 |
| CN | 106847182 | A | 6/2017 |
| CN | 108711400 | A | 10/2018 |

OTHER PUBLICATIONS

Second Office Action dated Apr. 2, 2020 for corresponding Chinese application 201810548349.7.

* cited by examiner

PIXEL CIRCUIT, DRIVING METHOD THEREOF AND DISPLAY DEVICE

CROSS-REFERENCE TO RELATED APPLICATIONS

This is a National Phase Application filed under 35 U.S.C. 371 as a national stage of PCT/CN2019/089630, filed on May 31, 2019, which claims the priority of Chinese Patent Application No. 201810548349.7, filed on May 31, 2018, and both applications are incorporated herein in their entirety by reference.

TECHNICAL FIELD

The present disclosure relates to a pixel circuit, a driving method for a pixel circuit, and a display device.

BACKGROUND

Organic light emitting diodes (OLEDs), also known as organic electroluminescent diodes, organic light emitting semiconductor devices, were discovered by a Chinese-American professor Ching W. Tang in a laboratory in 1979. The OLED has the advantages of self-luminescence, wide viewing angle, almost infinitely high contrast, low power consumption, extremely high response speed and the like.

SUMMARY

The present disclosure provides a pixel circuit, the pixel circuit including a switching sub-circuit, a threshold voltage extraction sub-circuit, an initialization sub-circuit, a feedback compensation sub-circuit, a driving transistor and a light emitting device; wherein, a first electrode of the driving transistor is supplied with a power supply voltage, a second electrode of the driving transistor is coupled to a first terminal of the light emitting device; the initialization sub-circuit is coupled to a control electrode of the driving transistor, and is configured to input a reference voltage to the control electrode of the driving transistor in response to an enable signal, so that the first terminal of the light emitting device is discharged by the driving transistor; the switching sub-circuit is coupled to the threshold voltage extraction sub-circuit and a data line, and is configured to write a data voltage input by the data line to the threshold voltage extraction sub-circuit in response to a scan signal; the threshold voltage extraction sub-circuit is coupled to the control electrode of the driving transistor, is configured to extract and store a threshold voltage of the driving transistor in response to the enable signal, and configured to apply the threshold voltage and the data voltage written by the switching sub-circuit to the control electrode of the driving transistor, so that the driving transistor inputs the data voltage to the light emitting device to drive the light emitting device to emit light; and the feedback compensation sub-circuit is coupled to the second terminal of the light emitting device and the data line, is configured to generate a data voltage compensation signal for a next display image frame according to an operating current of the light emitting device and supply the generated data voltage compensation signal to the data line.

In some embodiments, the feedback compensation sub-circuit is configured to determine whether the operating current of the light emitting device changes, in response to the operating current of the light emitting device increasing, the feedback compensation sub-circuit outputs the data voltage compensation signal with a negative value to the data line, and in response to the operating current of the light emitting device decreasing, the feedback compensation sub-circuit outputs the data voltage compensation signal with a positive value to the data line.

In some embodiments, the feedback compensation sub-circuit comprises a first resistor, a second resistor, a feedback resistor, a first comparator, a second comparator and a third storage capacitor; a first terminal of the first resistor is coupled to a second terminal of the light emitting device and a positive input terminal of the first comparator, and a second terminal of the first resistor is coupled to a ground electrode; a negative input terminal of the first comparator is coupled to a second terminal of the third storage capacitor and an output terminal of the second comparator; an output terminal of the first comparator is coupled to a positive input terminal of the second comparator; a first terminal of the second resistor is coupled to a negative input terminal of the second comparator, and a second terminal of the second resistor is supplied with the power supply voltage; a first terminal of the feedback resistor is coupled to the output terminal of the second comparator, and a second terminal of the feedback resistor is coupled to the negative input terminal of the second comparator; and a first terminal of the third storage capacitor is coupled to a data line, and is configured to store the data voltage compensation signal and provide it to the data line.

In some embodiments, the initialization sub-circuit comprises a second transistor; and a first electrode of the second transistor is supplied with the reference voltage, a second electrode of the second transistor is coupled to the control electrode of the driving transistor, and a control electrode of the second transistor is supplied with the enable signal.

In some embodiments, the threshold voltage extraction sub-circuit includes a fourth transistor, a first storage capacitor and a second storage capacitor;

a first electrode of the fourth transistor is coupled to a first terminal of the first storage capacitor, a second electrode of the fourth transistor is coupled to a first terminal of the light emitting device, and a control electrode of the fourth transistor is supplied with the enable signal;

a second terminal of the first storage capacitor is coupled to the control electrode of the driving transistor; and a first terminal of the second storage capacitor is coupled to the first terminal of the first storage capacitor, and a second terminal of the second storage capacitor is supplied with the reference voltage.

In some embodiments, the switching sub-circuit comprises a third transistor; and a first electrode of the third transistor is coupled to the data line, a second electrode of the third transistor is coupled to the first terminal of the first storage capacitor, and a control electrode of the third transistor is supplied with the scan signal.

In some embodiments, the pixel circuit further comprises a de-noising sub-circuit;

wherein the de-noising sub-circuit is coupled to a reset signal terminal and a ground electrode, and the de-noising sub-circuit is configured to input a ground voltage to the first terminal of the light emitting device to de-noise a potential of the first terminal of the light emitting device under a control of a reset signal input by the reset signal terminal.

In some embodiments, the de-noising sub-circuit comprises a fifth transistor; and a first electrode of the fifth transistor is coupled to the first terminal of the light emitting device, a second electrode of the fifth transistor is coupled to a ground electrode, and a control electrode of the fifth transistor is coupled to the reset signal terminal.

In some embodiments, the de-noising sub-circuit comprises a fifth transistor; and a first electrode of the fifth transistor is coupled to the first terminal of the light emitting device, a second electrode of the fifth transistor is coupled to a ground electrode, and a control electrode of the fifth transistor is supplied with the enable signal.

In some embodiments, an impedance of the fifth transistor is greater than an impedance of the driving transistor.

The present disclosure also provides a display device including the pixel circuit as described above.

The present disclosure also provides a driving method for a pixel circuit, the pixel circuit including a switching sub-circuit, a threshold voltage extraction sub-circuit, an initialization sub-circuit, a feedback compensation sub-circuit, a driving transistor and a light emitting device, the driving method includes:

in an initialization stage, inputting, by the initialization sub-circuit, a reference voltage to a control electrode of the driving transistor in response to an enable signal such that a first terminal of the light emitting device is discharged by the driving transistor;

in a threshold voltage extraction stage, extracting and storing, by the threshold voltage extraction sub-circuit, a threshold voltage of the driving transistor in response to the enable signal;

in a data writing stage, inputting, by the switching sub-circuit, a data voltage provided by a data line, to the threshold voltage extraction sub-circuit in response to a scan signal such that the threshold voltage extraction sub-circuit applies the threshold voltage of the driving transistor and the data voltage input by the switching sub-circuit to the control electrode of the driving transistor; and in a display stage, inputting, by the driving transistor, the data voltage to the light emitting device in response to the threshold voltage of the switching transistor and the data voltage, and generating, by the feedback compensation sub-circuit, a data voltage compensation signal for a next display image frame according to an operating current of the light emitting device and providing, by the feedback compensation sub-circuit, the generated data voltage compensation signal to the data line.

In some embodiments, the driving method for the pixel circuit further includes determining, by the feedback compensation sub-circuit, whether the operating current of the light emitting device changes, wherein in response to the operating current of the light emitting device increasing, the feedback compensation sub-circuit outputs the data voltage compensation signal with a negative value to the data line; and in response to the operating current of the light emitting device decreasing, the feedback compensation sub-circuit outputs the data voltage compensation signal with a positive value to the data line.

In some embodiments, the pixel circuit further includes a de-noising sub-circuit, and the driving method further includes: in the initialization stage, inputting, by the de-noising sub-circuit, a ground voltage to the light emitting device in response to a reset signal.

In some embodiments, the pixel circuit further comprises a de-noising sub-circuit, and the driving method further comprises: in the initialization stage, inputting, by the de-noising sub-circuit, a ground voltage to the light emitting device in response to the enable signal.

In some embodiments, an impedance of the de-noising sub-circuit is greater than an impedance of the driving transistor.

DETAILED DESCRIPTION

Figure 1:
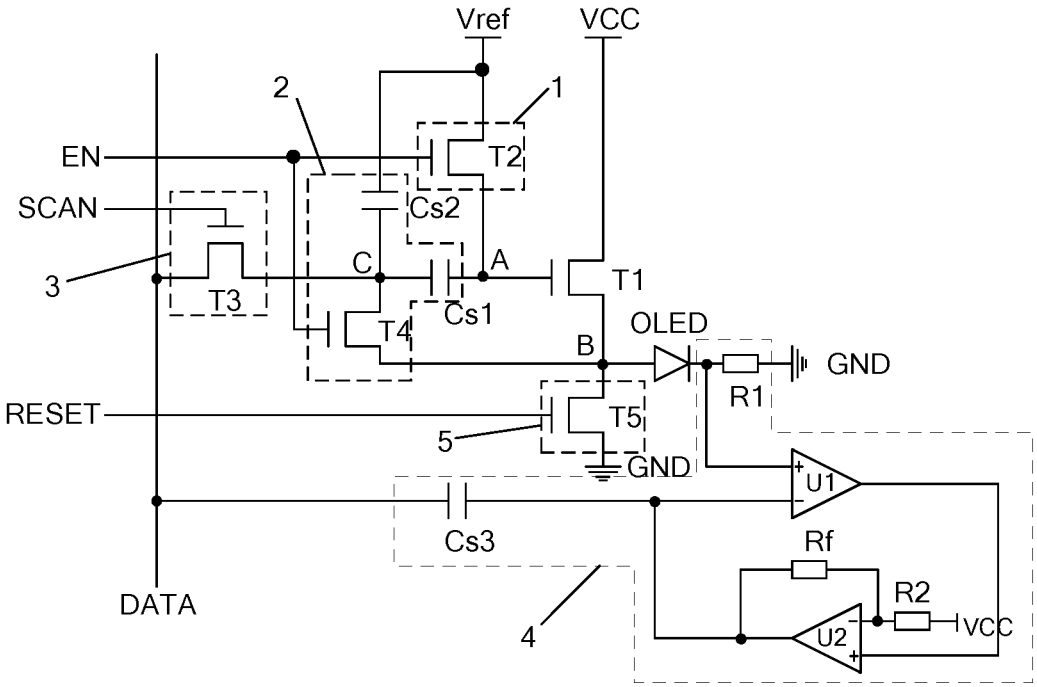
FIG. 1 is a schematic diagram of a pixel circuit according to some embodiments of the present disclosure.

For a better understanding of the technical solutions of the present disclosure by a person skilled in the art, the present disclosure will be described in details below in conjunction with the accompanying drawings and the embodiments.

At present, Low Temperature Polysilicon (LTPS) or a-Si is used in a switching transistor of a display device, and threshold voltages, carrier mobility, and series resistance of thin film transistors (TFTs) are inconsistent, resulting in dispersed characteristics of LTPS TFTs or a-Si TFTs. The different threshold voltages of the TFTs in a whole panel will cause different turn-on voltages for the TFTs, and the different threshold voltages will cause different output current in a saturation region and therefore result in a non-uniform OLED display. In addition, in a high-resolution product, when a low-amplitude signal is used to drive the switching transistor, the switching transistor may not be turned on immediately due to the long charging time of a storage capacitor, resulting in an abnormal display. Moreover, after the long charging time of the storage capacitor until the threshold voltage of the switching transistor reaches, the duration of the turn-on signal is extremely short, and in an extreme case, the abnormal display may occur. At present, there have been many solutions for solving the problem of the abnormal display caused by long charging time for the low-amplitude signal and different threshold voltages of the switching transistors, such as various internal compensation circuits such as 3T1C, 4T2C, 5T1C, 6T1C, 7T1C, 8T2C, where each compensation circuit aims at a specific improvement such as a threshold compensation in a pixel and an IR drop compensation, and the current compensation solution is more based on the improvement of the turn-on threshold voltage drift of the switching transistor. An OLED itself is a diode device, and there is basically not much research on the influence of the OLED's own voltage threshold drift on the display uniformity.

The transistors used in the embodiments of the present disclosure may be thin film transistors, field effect transistors, or other devices with the same characteristics, and since the source and the drain of the transistor may be interchangeable under certain conditions, the source and the drain are not distinguished from each other in terms of the connection relationship. In the embodiments of the present disclosure, to distinguish the source from the drain for the transistor, one is called a first electrode, the other is called a second electrode, and the gate is called a control electrode.

Further, the transistors can be classified into N-type and P-type transistors according to their characteristics, and the transistors are described as N-type transistors as examples in the following embodiments. When an N-type transistor is used, the first electrode is the drain electrode of the N-type transistor, and the second electrode is the source electrode of the N-type transistor. For example, when a high voltage is input to the gate, the transistor is turned on. It is different for the P-type transistor, and when a low voltage is input to the gate, the transistor is turned on. It is contemplated that, when the transistors are the P-type transistors, how to implement the present disclosure would be readily understood by a person skilled in the art without the inventive effort and, therefore, the embodiments regarding the P-type transistors are also within the scope of the present disclosure.

Some embodiments of the present disclosure provide a pixel circuit, the pixel circuit including: a switching sub-circuit, a threshold voltage extraction sub-circuit, an initialization sub-circuit, a feedback compensation sub-circuit, a driving transistor and a light emitting device.

For example, a first electrode of the driving transistor is supplied with a power supply voltage, and a second electrode of the driving transistor is coupled to a first terminal of the light emitting device. The initialization sub-circuit is coupled to a control electrode of the driving transistor, and the initialization sub-circuit is configured to input a reference voltage to the control electrode of the driving transistor in response to an enable signal, so that the first terminal of the light emitting device is discharged by the driving transistor. The switching sub-circuit is coupled to the threshold voltage extraction sub-circuit and a data line, and the switching sub-circuit is configured to write a data voltage input from the data line to the threshold voltage extraction sub-circuit in response to a scan signal. The threshold voltage extraction sub-circuit is coupled to the control electrode of the driving transistor, the threshold voltage extraction sub-circuit is configured to extract and store a threshold voltage of the driving transistor in response to the enable signal, and is configured to apply the threshold voltage and the data voltage written through the switching sub-circuit to the control electrode of the driving transistor, so that the driving transistor inputs the data voltage to the light emitting device to drive the light emitting device to emit light.

For another example, the feedback compensation sub-circuit is coupled to a second terminal of the light emitting device and the data line, and the feedback compensation sub-circuit is configured to generate a data voltage compensation signal for a next display image frame according to a light emitting current of the light emitting device and supply the generated data voltage compensation signal to the data line.

In the pixel circuit of some embodiments of the present disclosure, the threshold voltage extraction sub-circuit is configured to extract and store the threshold voltage of the driving transistor in response to the enable signal, and is configured to apply the threshold voltage and the data voltage written through the switching sub-circuit to the control electrode of the driving transistor; in addition, the feedback compensation sub-circuit is configured to generate the data voltage compensation signal for a next display image frame according to the light emitting current of the light emitting device and supply the generated data voltage compensation signal to the data line, thereby an influence caused by a threshold voltage drift of the light emitting device itself can be eliminated and a display uniformity is improved.

As shown in FIG. 1, an embodiment of the present disclosure provides a pixel circuit, including: a switching sub-circuit 3, a threshold voltage extraction sub-circuit 2, an initialization sub-circuit 1, a feedback compensation sub-circuit 4, a driving transistor T1, and a light emitting device OLED.

The initialization sub-circuit 1 is configured to input a first reference voltage to a node A under a control of a first enable signal, and a driving transistor T1 is turned on, so that a node B is discharged by the first power supply voltage through the driving transistor T1. Here, the node A is a connection node between the initialization sub-circuit 1 and a control electrode of the driving transistor T1; the node B is a connection node between the light emitting device OLED and a second electrode of the driving transistor T1.

The threshold voltage extraction sub-circuit 2 is configured to charge a node C by a voltage written to the node B to extract and store a threshold voltage of the driving transistor T1; for example, the voltage of the node B is a voltage obtained by applying a second power supply voltage to the driving transistor T1 to charge the node B; the node C is a connection node between the switching sub-circuit 3 and the threshold voltage extraction sub-circuit 2. The switching sub-circuit 3 is configured to write a data voltage signal to the node C under a control of a first scan signal. The driving transistor T1 is configured to drive the light emitting device OLED to emit light. The feedback compensation sub-circuit 4 is configured to sample a current of the light emitting device OLED in a light emitting stage, and generate a data voltage compensation signal for a next display image frame to compensate the data voltage.

Since the feedback compensation sub-circuit 4 is added to the pixel circuit in the embodiment, and the feedback compensation sub-circuit 4 can determine whether the threshold voltage of the light emitting device OLED shifts according to the current of the light emitting device OLED in the light emitting stage. When it is determined that the threshold voltage shifts, a corresponding compensation data voltage signal can be generated according to the sampled current of the light emitting device OLED, so that the data voltage signal is compensated by the compensation data voltage signal for the next display image frame, thereby realizing the display uniformity of a display device with the pixel circuit in the embodiment.

For example, the feedback compensation sub-circuit 4 outputs a data voltage compensation signal with a negative value to the data line in response to the light emitting current of the light emitting device OLED being large, and the feedback compensation sub-circuit 4 outputs a data voltage compensation signal with a positive value to the data line in response to the light emitting current of the light emitting device OLED being small.

In some embodiments, the pixel circuit further includes a de-noising sub-circuit 5, the de-noising sub-circuit 5 is coupled to a reset signal terminal and a ground terminal, and is configured to input a ground voltage to a first terminal of the light emitting device OLED, for example, the node B, under a control of a first reset signal input from the reset signal terminal, so as to de-noise a potential of the node B.

In some embodiments, the de-noising sub-circuit 5 includes a fifth transistor T5, including a first electrode coupled to the first terminal of the light emitting device OLED, a second electrode coupled to the ground electrode, and a control electrode coupled to a reset signal terminal RESET. For example, the first electrode of the fifth transistor T5 is coupled to the node B, the second electrode of the fifth transistor T5 is coupled to the ground electrode GND, and the control electrode of the fifth transistor T5 is coupled to the reset signal terminal RESET. In other embodiments of the present disclosure, the control electrode of the fifth transistor T5 may alternatively be coupled to the enable signal terminal EN.

Figure 2:
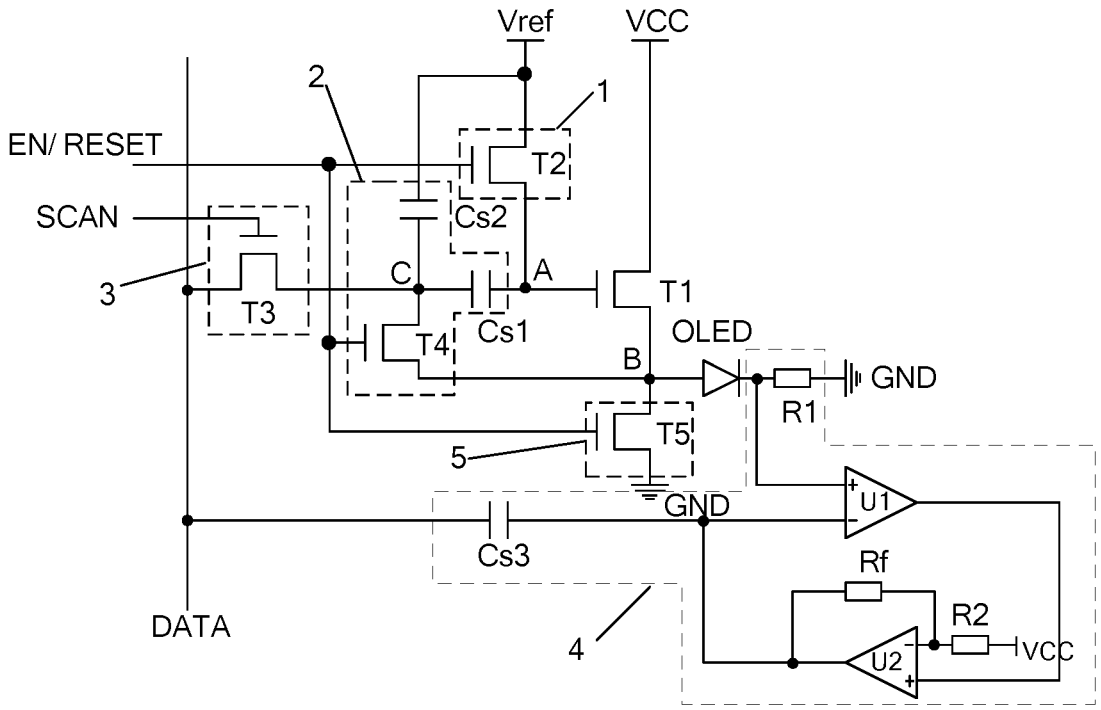
FIG. 2 is a schematic diagram of a pixel circuit according to some embodiments of the present disclosure.

As shown in FIG. 2, taking the example that the control electrode of the fifth transistor T5 is coupled to the reset signal terminal RESET, in an initialization stage, the reset signal terminal RESET inputs a first reset signal (e.g., a high level signal) to the control electrode of the fifth transistor T5, and the fifth transistor T5 is turned on. At this time, since the second electrode of the fifth transistor T5 is coupled to the ground electrode GND, the node B can be completely discharged through the ground electrode GND to prevent a glitch voltage signal from passing therethrough, and charges at the node B are rapidly discharged, so that driving charges of the pixel circuit are cleared.

In other embodiments of the present disclosure, the fifth transistor T5 is coupled to the enable signal terminal EN, and operates in the same manner as the fifth transistor T5 coupled to the reset signal terminal RESET. If the control electrode of the fifth transistor T5 is coupled to the enable signal terminal EN, that is, the fifth transistor T5 is controlled by the enable signal, the wiring of the pixel circuit can be optimized.

In this embodiment, by designing the width-to-length ratios of the fifth transistor T5 and the driving transistor T1 so that the impedance between the first electrode and the second electrode of the fifth transistor T5 is much higher than the impedance between the first electrode and the second electrode of the driving transistor T1, the node B has a same voltage as the first electrode of the driving transistor T1 when the fifth transistor T5 and the driving transistor T1 are turned on simultaneously.

The initialization sub-circuit 1 in this embodiment includes a second transistor T2, a first electrode of the second transistor T2 is supplied with a reference voltage, a second electrode of the second transistor T2 is coupled to the control electrode of the driving transistor T1, and a control electrode of the second transistor T2 is supplied with the enable signal. For example, the second transistor T2 has a first electrode coupled to the reference voltage terminal Vref, a second electrode coupled to the node A, and a control electrode coupled to the enable signal terminal EN.

For example, in the initialization stage, the enable signal terminal EN inputs the first enable signal (e.g., a high level signal), and the second transistor T2 is turned on. A first reference voltage (e.g., a high level signal) is applied through the reference voltage terminal Vref to turn on the driving transistor T1. At this time, the first power supply voltage is 0V, so that the potential of the node B is pulled down to 0V to complete discharging charges of the driving voltage of the light emitting device OLED.

The threshold voltage extraction sub-circuit 2 in the present embodiment includes: a fourth transistor T4, a first storage capacitor Cs1, and a second storage capacitor Cs2, a first electrode of the fourth transistor T4 is coupled to a first terminal of the first storage capacitor Cs1, a second electrode of the fourth transistor T4 is coupled to a first terminal of the light emitting device OLED, a control electrode of the fourth transistor T4 is supplied with the enable signal; a second terminal of the first storage capacitor Cs1 is coupled to the control electrode of the driving transistor T1; a first terminal of the second storage capacitor Cs2 is coupled to the first terminal of the first storage capacitor Cs1, and a second terminal of the second storage capacitor Cs2 is supplied with the reference voltage. For example, the fourth transistor T4 has a first electrode coupled to the node C, a second electrode coupled to the node B, and a control electrode coupled to the enable signal terminal EN. The first terminal of the first storage capacitor Cs1 is coupled to the node C, and the second terminal of the first storage capacitor Cs1 is coupled to the node A. The first terminal of the second storage capacitor Cs2 is coupled to the node C, and the second terminal is coupled to the reference voltage terminal Vref.

For example, in a threshold voltage extraction stage, the first enable signal input from the enable signal terminal EN is a high level signal, the second transistor T2 and the fourth transistor T4 are turned on. The first reference voltage (e.g., a high level signal) is applied through the reference voltage terminal Vref, so that a high level signal is input the node A, and the driving transistor T1 is turned on.

At this time, a first power supply voltage signal of the power supply voltage terminal VCC is jumped from the 0V voltage at the initialization stage to the second power supply voltage signal, i.e., the high level signal. The potential of the node B follows the same potential at the first electrode of the driving transistor T1, and since the driving transistor T1 is turned on, channel carriers flow from the gate barrier to the drain channel, so that the node B voltage is increased. As the node B voltage increasing, the gate-source (voltage between the first electrode and the control electrode) turn-on voltage $V_{th_t1}=V_A-V_B$ of the driving transistor T1 is decreased accordingly until a critical threshold voltage reaches, at which time the driving transistor T1 is turned off.

When the driving transistor T1 is turned off, the potential at the node B is $V_B=V_A-V_{th_t1}=V_{ref}-V_{th}$; meanwhile, since the fourth transistor T4 is turned on, the voltages of the first and second electrodes of the fourth transistor are the same, i.e., the potential at the node C of the first storage capacitor Cs1 is charged to $V_{ref}-V_{th}$; and $V_A=V_{ref}$;

$$\Delta V_{C_{S1}}=V_A-V_C=V_{ref}-(V_{ref}-V_{th})=V_{th}.$$

The above process completes the extraction of the threshold voltage of the driving transistor T1 and stores the threshold voltage of the driving transistor T1 in the threshold voltage extraction sub-circuit 2.

In this embodiment, the switching sub-circuit 3 may include a third transistor T3, a first electrode of the third transistor T3 is coupled to the data line, a second electrode of the third transistor T3 is coupled to the first terminal of the first storage capacitor Cs1, and a control electrode of the third transistor T3 is supplied with the scan signal. For example, the first electrode of the second transistor T2 is coupled to the reference voltage terminal Vref, the second electrode of the second transistor T2 is coupled to the node A, and the control electrode of the second transistor T2 is coupled to the enable signal terminal EN.

A data writing stage is after the threshold voltage extracting stage, and in data writing stage, a scan line SCAN inputs a first scan signal (e.g., a high level signal) to the third transistor T3, and the enable signal terminal EN inputs a second enable signal (e.g., a low level signal). The second transistor T2 in the initialization sub-circuit 1 and the fourth transistor T4 in the threshold voltage extraction sub-circuit 2 described above are both turned off. The power supply voltage terminal VCC coupled to the first electrode of the driving transistor T1 inputs a first power supply voltage (e.g., a low level signal). Since the first storage capacitor Cs1 in the threshold voltage extraction sub-circuit 2 is charged and stores the threshold voltage of the driving transistor T1 in the threshold voltage extraction stage, the driving transistor T1 is turned on in response to the stored threshold voltage, and the third transistor T3 is turned on in response to the first scan signal. And since the fourth transistor T4 is turned off, and the first power supply voltage is the low level signal, the second storage capacitor Cs2 makes the potential at the node B not affected by a static voltage.

The data voltage signal inputted to the data line DATA is transmitted to the second electrode of the third transistor T3, i.e., the node C, and after the third transistor T3 is turned on, $V_C$ is changed from $V_{ref}-V_{th}$ to $V_{data}$, i.e., $\Delta V_C=(V_{data}-(V_{ref}-V_{th}))$; because the voltages of the capacitor plates are consistent, the voltage change at the node C is finally coupled to the node A voltage, the previous $V_A=V_{ref}$; and the voltage at the node A is changed, by the charging of the first storage capacitor Cs1, into the voltage:

$$V_A'=V_A+\Delta V_C=V_{ref}+(V_{data}-(V_{ref}-V_{th}))=V_{data}+V_{th}$$

Since the data voltage written on the data line DATA is stored in the first storage capacitor Cs1, and the voltage inputted to the first electrode of the driving transistor T1 from the power supply voltage terminal VCC is a low level signal, the driving transistor T1 is turned off in a reverse direction, the driving transistor T1 is turned off, and the light emitting device OLED does not emit light.

In some embodiments of the present disclosure, the first electrode of the driving transistor T1 is coupled to the power supply voltage terminal VCC, the second electrode of the driving transistor T1 is coupled to the node B, and the control electrode of the driving transistor T1 is coupled to the node A.

The feedback compensation sub-circuit 4 in the present embodiment may include: a first resistor R1, a second resistor R2, a feedback resistor Rf, a first comparator U1, a second comparator U2 and a third storage capacitor Cs3. A first terminal of the first resistor R1 is coupled to a second electrode of the light emitting device OLED and a positive input terminal of the first comparator U1, and a second terminal of the first resistor R1 is coupled to the ground electrode GND. A negative input terminal of the first comparator U1 is coupled to a second terminal of the third storage capacitor Cs3 and an output terminal of the second comparator U2, and an output terminal of the first comparator U1 is coupled to a positive input terminal of the second comparator U2. A first terminal of the second resistor R2 is coupled to a negative input terminal of the second comparator U2 and a second terminal of the feedback resistor Rf, and a second terminal of the second resistor R2 is coupled to the power supply voltage terminal VCC. A first terminal of the feedback resistor Rf is coupled to the output terminal of the second comparator U2. A first terminal of the third storage capacitor Cs3 is coupled to the data line DATA.

In a display stage, the enable signal terminal supplies a second enable signal (e.g., a low level signal) to the second transistor T2 and the fourth transistor T4, and both the second transistor T2 and the fourth transistor T4 are turned off. Since the first storage capacitor Cs1 in the threshold voltage extraction sub-circuit 2 is charged and stores the threshold voltage of the driving transistor T1 in the threshold voltage extraction stage, the power supply voltage signal inputted from the power supply voltage terminal VCC to the first electrode of the driving transistor T1 becomes the second power supply voltage (for example, a high level signal), so that the driving transistor T1 is turned on, the voltage loaded on the light emitting device OLED is $V_{data}$, and the current is $I_{data}$; $V_{oled}=V_{data}$.

$$I_{data}=(1/2)\times(W/L)\times(U\times C)(V_{data}-V_{th_oled})^2.$$

In the current formula of the light emitting device OLED, W/L is a channel width-to-length ratio of the driving transistor T1; U is the electron mobility of the driving transistor T1; C is the intrinsic capacitance of the driving transistor T1.

As can be seen from the current formula of the light emitting device OLED, the data voltage is related to a target voltage and a self turn-on voltage (threshold turn-on voltage) of the light emitting device OLED, and the target voltage is a voltage theoretically causing the light emitting device OLED to emit light, that is, a signal level which is theoretically provided by a chip to a data line when the light emitting device OLED emits light. An initial threshold turn-on voltage of the light emitting device OLED is defined as $V_{th_oled}$, the current $I_{oled}$ changes due to the $V_{th_oled}$ shift, and the display brightness changes. In order to make the data voltage completely follow the target voltage, the influence of the threshold turn-on voltage of the light emitting device OLED needs to be eliminated.

However, the pixel circuit of the present embodiment is additionally provided with the feedback compensation sub-circuit 4, which employs two stages of comparators, i.e., the first comparator U1 and the second comparator U2, for difference comparison. For example, the first resistor R1 in the feedback compensation sub-circuit 4 is a sampling resistor, and the sampling resistor is consistent with the resistance of the light emitting device OLED operating in the amplification region. In one display image frame, when the threshold voltage of the light emitting device OLED shifts to cause the magnitude of the driving current to change, the changed voltage is inputted to the positive input terminal of the first comparator U1 through the sampling resistor, according to the following formula:

$$\Delta U_{1_out}=V_{data}-(V_{data}-\Delta I'_{oled}\times R_1)=\Delta I'_{oled}\times R_1;$$

when the threshold turn on voltage $V_{th_oled}$ of the light emitting device OLED itself does not change with time, the difference output by the output terminal of the second comparator U2 is 0, and the data voltage signal of the next display image frame does not need to be compensated. When the threshold voltage $V_{th_oled}$ of the light emitting device OLED changes with time, $I'_{oled}$ changes. At this time, the second comparator U2 feeds back the difference to the data line DATA to compensate the data voltage in the next display image frame. For example, $I'_{oled}$ is the current magnitude of the corresponding light emitting device OLED after the threshold voltage shift occurs, and the corresponding compensation value when displaying the next frame is:

$$U_{2_out}=V_{th_oled}-((R_2+R_f)/R_2)\times\Delta U_{1_out}\approx V_{th_oled}-\Delta U_{1_out};$$

that is, $U_{2_out}=V_{th_oled}-\Delta I_{oled}\times R_1$.

If the threshold voltage of the light emitting device OLED is decreased in the previous frame, as known from the V-I characteristics, the channel carriers move faster, the light emitting current increases, the voltage division of the first resistor R1 increases, therefore, the $U_{2_out}$ (the output terminal of the second comparator U2) outputs a negative value, the difference output voltage is stored in the third storage capacitor Cs3, and since the capacitor voltage does not change suddenly, the stored voltage is added with the data voltage signal $V_{data}$ of the next display image frame for compensation, and $V'_{oled}$ for the next display image frame is decreased, thereby eliminating the influence of the threshold voltage shift of the light emitting device OLED.

If the threshold voltage of the light emitting device OLED increases, as known from the V-I characteristics, the current of the light emitting device OLED decreases, the voltage division of the first resistor R1 decreases, and the initial threshold voltage $V_{th_oled}$ is stored in the first storage capacitor Cs1, so the $U_{2_out}$ outputs a positive value, the difference output voltage is stored in the third storage capacitor Cs3, and since the capacitor voltage does not change suddenly, the stored voltage is added with the data voltage signal $V_{data}$ of the next display image frame for current compensation, and the compensation signal is reflected on the data superimposition of the next frame:

$$V'_{data[n+1]}=V_{data[n+1]}+U_{2_out}.$$

Thus, compensation for the change in the V-I characteristics of the light emitting device OLED itself is completed.

The embodiment of the present disclosure provides a driving method of a pixel circuit, where the pixel circuit includes: a switching sub-circuit, a threshold voltage extraction sub-circuit, an initialization sub-circuit, a feedback compensation sub-circuit, a driving transistor and a light emitting device. The driving method of the pixel circuit may include an initialization stage, a threshold voltage extraction stage, a data writing stage, and a display stage.

In the initialization stage, the initialization sub-circuit inputs a reference voltage to a control electrode of the driving transistor in response to an enable signal, so that the first terminal of the light emitting device is discharged through the driving transistor;

in the threshold voltage extraction stage, the threshold voltage extraction sub-circuit extracts and stores a threshold voltage of the driving transistor in response to the enable signal;

in the data writing stage, the switching sub-circuit inputs a data voltage supplied by a data line to the threshold voltage extraction sub-circuit in response to a scan signal, so that the threshold voltage extraction sub-circuit applies the threshold voltage of the driving transistor and the data voltage input by the switching sub-circuit to a control electrode of the driving transistor;

in the display stage, the driving transistor inputs the data voltage to the light emitting device in response to the threshold voltage of the switching transistor and the data voltage, the feedback compensation sub-circuit generates a data voltage compensation signal for a next display image frame according to a light emitting current of the light emitting device and supplies the generated data voltage compensation signal to the data line.

In the driving method for the pixel circuit according to some embodiments of the present disclosure, the driving transistor responds to the threshold voltage of the switching transistor and the data voltage to input the data voltage to the light emitting device, the feedback compensation sub-circuit generates the data voltage compensation signal for the next display image frame according to the light emitting current of the light emitting device, and provides the generated data voltage compensation signal to the data line, thereby eliminating the influence caused by the threshold voltage shift of the light emitting device itself, and further improving the display uniformity.

As shown in FIGS. 1 and 2, the present embodiment provides a pixel circuit including: a switching sub-circuit 3, a threshold voltage extraction sub-circuit 2, an initialization sub-circuit 1, a feedback compensation sub-circuit 4, a de-noising sub-circuit 5, a driving transistor T1 and a light emitting device OLED; for example, the initialization sub-circuit 1 includes a second transistor T2. The switching sub-circuit 3 includes a third transistor T3. The threshold voltage extraction sub-circuit 2 includes a fourth transistor T4, a first storage capacitor Cs1, and a second storage capacitor Cs2. The de-noising sub-circuit 5 includes a fifth transistor T5. The feedback compensation sub-circuit 4 may include a first resistor R1, a second resistor R2, a feedback resistor Rf, a first comparator U1, a second comparator U2 and a third storage capacitor Cs3.

For example, a first electrode of the second transistor T2 is coupled to a reference voltage terminal Vref, a second electrode of the second transistor T2 is coupled to a node A, and a control electrode of the second transistor T2 is coupled to an enable signal terminal EN. A first electrode of the second transistor T2 is coupled to a reference voltage terminal Vref, a second electrode of the second transistor T2 is coupled to a node A, and a control electrode of the second transistor T2 is coupled to an enable signal terminal EN.

A first electrode of the fourth transistor T4 is coupled to a node C, a second electrode of the fourth transistor T4 is coupled to a node B, and a control electrode of the fourth transistor T4 is coupled to the enable signal terminal EN. A first terminal of the first storage capacitor Cs1 is coupled to the node C, and a second terminal of the first storage capacitor Cs1 is coupled to the node A. A first terminal of the second storage capacitor Cs2 is coupled to the node C, and a second terminal of the second storage capacitor Cs2 is coupled to the reference voltage terminal Vref.

A first electrode of the fifth transistor T5 is coupled to the node B, a second electrode of the fifth transistor T5 is coupled to the ground electrode GND, and a control electrode of the fifth transistor T5 is coupled to the reset signal terminal RESET or the enable signal terminal EN. A first electrode of the driving transistor T1 is coupled to a power supply voltage terminal VCC, a second electrode of the driving transistor T1 is coupled to the node B, and a control electrode of the driving transistor T1 is coupled to the node A.

A first terminal of the first resistor R1 is coupled to a second terminal of the light emitting device OLED and a positive input terminal of the first comparator U1, and a second terminal of the first resistor R1 is coupled to the ground electrode GND. A negative input terminal of the first comparator U1 is coupled to a second terminal of the third storage capacitor Cs3 and an output terminal of the second comparator U2, and an output terminal of the first comparator U1 is coupled to a positive input terminal of the second comparator U2. A first terminal of the second resistor R2 is coupled to a negative input terminal of the second comparator U2 and a second terminal of the feedback resistor Rf, and a second terminal of the second resistor R2 is coupled to the power supply voltage terminal VCC. A first terminal of the feedback resistor Rf is coupled to the output terminal of the second comparator U2. A first terminal of the third storage capacitor Cs3 is coupled to a data line DATA.

Figure 3:
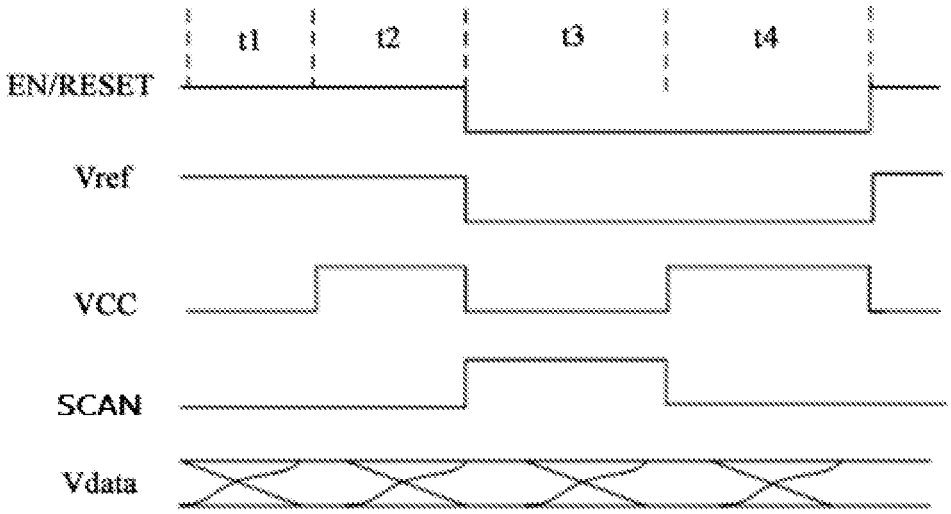
FIG. 3 is a timing chart illustrating a driving method for the pixel circuit shown in FIG. 2.

A driving method for the pixel circuit will be described with reference to a timing chart shown in FIG. 3, in which the reset signal terminal RESET and the enable signal terminal EN are taken as an example, but they may be provided separately.

In the initialization stage t1, a first enable signal input from the enable signal terminal EN is, for example, a high level signal, and the second transistor T2 is turned on. A first reference voltage (e.g., a high level signal) is applied through the reference voltage terminal Vref to turn on the driving transistor T1. At this time, a scan signal inputted to the scan line SCAN is a low level signal. A first power supply voltage output by the power supply voltage terminal VCC is 0V voltage, so that the potential of the node B is pulled down to 0V to release charges of the driving voltage of the light emitting device OLED.

Taking the control electrode of the fifth transistor T5 coupled to the reset signal terminal RESET as an example, a first reset signal (e.g., a high level signal) is input to the reset signal terminal RESET in the initialization stage, the fifth transistor T5 is turned on, and at this time, since the second electrode of the fifth transistor T5 is coupled to the ground electrode GND, the node B may be completely discharged through the ground electrode GND, so that the glitch voltage signal may be prevented from passing therethrough, and the charges of the node B are rapidly released, so that the driving charges of the pixel circuit are cleared.

In the threshold voltage extraction stage t2, the first enable signal input to the enable signal terminal EN is a high level signal, and the second transistor T2 and the fourth transistor T4 are turned on. The first reference voltage (e.g., a high level signal) is applied through the reference voltage terminal Vref, so that the node A is at a high level, so that the driving transistor T1 is turned on.

At this time, the first power supply voltage signal at the power supply voltage terminal VCC is changed from the 0V voltage in the initialization stage to the second power supply voltage signal, i.e., the high level signal, the potential of the node B follows the potential of the first electrode of the driving transistor T1, and since the driving transistor T1 is turned on, channel carriers flow from the gate barrier to the drain channel, so that the node B voltage is increased, and as the voltage at the node B increasing, the gate-source (voltage between the first electrode and the control electrode) turn-on voltage of the driving transistor T1 $V_{th_t1}=V_A-V_B$ is decreased accordingly until a critical threshold voltage is reached, at which time the driving transistor T1 is turned off.

When the driving transistor T1 is turned off, the potential of the node B is $V_B=V_A-V_{th_t1}=V_{ref}-V_{th}$. Meanwhile, since the fourth transistor T4 is turned on, the voltages of the first and second electrodes of the fourth transistor are the same, i.e., the potential of the node C of the first storage capacitor Cs1 is charged to $V_{ref}-V_{th}$; and $V_A=V_{ref}$;

$$\Delta V_{C_{S1}}=V_A-V_C=V_{ref}-(V_{ref}-V_{th})=V_{th}.$$

The process completes the extraction of the threshold voltage of the driving transistor T1 and stores the threshold voltage of the driving transistor T1 in the threshold voltage extraction sub-circuit 2.

In the data writing stage t3, the scan line SCAN inputs a first scan signal (e.g., a high level signal) to the third transistor T3, and the enable signal terminal EN inputs a second enable signal (e.g., a low level signal). The second transistor T2 and the fourth transistor T4 are both turned off. The power supply voltage terminal VCC coupled to the first electrode of the driving transistor T1 inputs a first power supply voltage (e.g., a low level signal), and since the first storage capacitor Cs1 in the threshold voltage extraction sub-circuit 2 is charged and stores the threshold voltage of the driving transistor T1 in the threshold voltage extraction stage, the driving transistor T1 is turned on in response to the stored threshold voltage, and the third transistor T3 is turned on in response to the first scan signal. And since the fourth transistor T4 is turned off, and the first power supply voltage is a low level signal, the second storage capacitor Cs2 makes the potential of the node B not affected by the static voltage.

The data voltage signal inputted to the data line DATA is transmitted to the second electrode of the third transistor T3, i.e., the node C, and after the third transistor T3 is turned on, $V_C$ is changed from $V_{ref}-V_{th}$ to $V_{data}$, i.e., $\Delta V_C=(V_{data}-(V_{ref}-V_{th}))$. Because the voltages of the capacitor plates are consistent, the voltage change of the node C is finally coupled to the node A, the previous $V_A=V_{ref}$; and the voltage at the node A is changed, by the charging of the first storage capacitor Cs1, into the voltage:

$$\Delta V_A=V_A+\Delta V_C=V_{ref}+(V_{data}-(V_{ref}-V_{th}))=V_{data}+V_{th}.$$

Since the data voltage written on the data line DATA is stored in the first storage capacitor Cs1, and the voltage inputted to the first electrode of the driving transistor T1 from the power supply voltage terminal VCC is a low level signal, the driving transistor T1 is turned off in the reverse direction, the driving transistor T1 is turned off, and the light emitting device OLED does not emit light.

In the display stage t4, the enable signal terminal provides the second enable signal, i.e. the low-level signal, to the second transistor T2 and the fourth transistor T4, and both the second transistor T2 and the fourth transistor T4 are turned off. Since the first storage capacitor Cs1 in the threshold voltage extraction sub-circuit 2 is charged and stores the threshold voltage of the driving transistor T1 in the threshold voltage extraction stage, the power supply voltage signal inputted from the power supply voltage terminal VCC to the first electrode of the driving transistor T1 becomes the second power supply voltage signal, i.e., the high level signal, so that the driving transistor T1 is turned on, the voltage loaded on the light emitting device OLED is $V_{data}$, and the current is $I_{data}$; $V_{oled}=V_{data}$.

$$I_{data}=(\tfrac{1}{2}\times(W/L)\times(U\times C)(V_{data}-V_{th_oled})^2.$$

In the current formula of the light emitting device OLED, W/L is a channel width-to-length ratio of the driving transistor T1; U is the electron mobility of the driving transistor T1; C is the intrinsic capacitance of the driving transistor T1.

As can be seen from the current formula of the light emitting device OLED, the data voltage is related to a target voltage and a turn-on voltage (threshold voltage) of the light emitting device OLED, and the target voltage is a voltage theoretically causing the light emitting device OLED to emit light, that is, a signal level which is theoretically provided by a chip to a data line when the light emitting device OLED emits light. The initial threshold voltage of the light emitting device OLED is defined as $V_{th_oled}$, the current $I_{oled}$ changes due to the $V_{th_oled}$ shift, and the display brightness changes. In order to make the data voltage completely follow the target voltage, it is required to eliminate the influence of the threshold turn-on voltage of the light emitting device OLED.

However, the pixel circuit of the present embodiment is additionally provided with the feedback compensation sub-circuit 4, which employs two stages of comparators, i.e., the first comparator U1 and the second comparator U2, for difference comparison. For example, the first resistor R1 in the feedback compensation sub-circuit 4 is a sampling resistor, and the sampling resistor is consistent with the resistance of the light emitting device OLED operating in the amplification region. In one display image frame, when the threshold voltage of the light emitting device OLED shifts to cause the magnitude of the driving current to change, the changed voltage is inputted to the positive input terminal of the first comparator U1 through the sampling resistor, according to the following formula:

$$\Delta U_{1_out}=V_{data}-(V_{data}-\Delta I'_{oled}\times R_1)=\Delta I'_{oled}\times R_1;$$

When the threshold voltage $V_{th_oled}$ of the light emitting device OLED itself does not change with time, the difference output by the output terminal of the second comparator U2 is 0, and the data voltage signal of the next display image frame does not need to be compensated. When the threshold voltage $V_{th_oled}$ of the light emitting device OLED changes with time, $I'_{oled}$ changes. At this time, the second comparator U2 feeds back the difference to the data line DATA to compensate the data voltage in the next display image frame. For example, $I'_{oled}$ is the current magnitude of the corresponding light emitting device OLED after the threshold voltage shift occurs, and the corresponding compensation value when displaying the next frame is:

$$U_{2_out}=V_{th_oled}-((R_2+R_f)/R_2)\times\Delta U_{1_out}\approx V_{th_oled}-\Delta U_{1_out};$$

that is, $U_{2_out}=V_{th_oled}-\Delta I_{oled}\times R_1$.

If the threshold voltage of the light emitting device OLED decreased in the previous frame, as known from the V-I characteristics, the channel carriers move faster, the light emitting current increases, the voltage division of the first resistor R1 increases, and the initial threshold voltage $V_{th_oled}$ is stored in the first storage capacitor Cs1, so the $U_{2_out}$ (the output terminal of the second comparator U2) outputs a negative value, the difference output voltage is stored in the third storage capacitor Cs3, and since the capacitor voltage does not change suddenly, the stored voltage is added with the data voltage signal $V_{data}$ of the next display image frame for compensation, so as to reduce $I'_{oled}$ in the next frame, thereby eliminating the influence of the threshold voltage shift of the light emitting device OLED.

If the threshold voltage of the light emitting device OLED increases, as known from the V-I characteristics, the current of the light emitting device OLED decreases, the voltage division of the first resistor R1 decreases, and the initial threshold voltage $V_{th_oled}$ is stored in the first storage capacitor Cs1, so the $U_{2_out}$ outputs a positive value, the difference output voltage is stored in the third storage capacitor Cs3, and since the capacitor voltage does not change suddenly, the stored voltage is added with the data voltage $V_{data}$ of the next display image frame for current compensation, and the compensation signal is reflected on the data superimposition for the next frame:

$$V'_{data[n+1]}=V_{data[n+1]}+U_{2_out};$$

Thus, compensation for the change in the V-I characteristics of the light emitting device OLED itself is completed.

The present embodiment provides a display device, which includes the pixel circuit according to the embodiments of the present disclosure, so that the display image of the display device in the present embodiment is uniform.

The display device of the embodiment can be any product or component with a display function, such as an OLED panel, electronic paper, a mobile phone, a tablet computer, a television, a display, a notebook computer, a digital photo frame, a navigator, and the like.

It is to be understood that, the above embodiments are merely exemplary embodiments that are employed to illustrate the principles of the present disclosure, and that the present disclosure is not limited thereto. It will be apparent to the person skilled in the art that various changes and modifications can be made therein without departing from the spirit and scope of the disclosure, and these are to be considered as the scope of the disclosure.

What is claimed is:

1. A pixel circuit, comprising: a switching sub-circuit, a threshold voltage extraction sub-circuit, an initialization sub-circuit, a feedback compensation sub-circuit, a driving transistor and a light emitting device; wherein, a first electrode of the driving transistor is supplied with a power supply voltage, a second electrode of the driving transistor is coupled to a first terminal of the light emitting device;

the initialization sub-circuit is coupled to a control electrode of the driving transistor, and is configured to input a reference voltage to the control electrode of the driving transistor in response to an enable signal, so that the first terminal of the light emitting device is discharged by the driving transistor;

the switching sub-circuit is coupled to the threshold voltage extraction sub-circuit and a data line, and is configured to write a data voltage input by the data line to the threshold voltage extraction sub-circuit in response to a scan signal;

the threshold voltage extraction sub-circuit is coupled to the control electrode of the driving transistor, is configured to extract and store a threshold voltage of the driving transistor in response to the enable signal, and configured to apply the threshold voltage and the data voltage written by the switching sub-circuit to the control electrode of the driving transistor, so that the driving transistor inputs the data voltage to the light emitting device to drive the light emitting device to emit light; and the feedback compensation sub-circuit is coupled to a second terminal of the light emitting device and the data line, is configured to generate a data voltage compensation signal for a next display image frame according to an operating current flowing through the light emitting device and supply the generated data voltage compensation signal to the data line;

wherein the feedback compensation sub-circuit is configured to determine whether the operating current of the light emitting device changes, in response to the operating current of the light emitting device increasing, the feedback compensation sub-circuit outputs the data voltage compensation signal with negative value to the data line, in response to the operating current of the light emitting device decreasing, the feedback compensation sub-circuit outputs the data voltage compensation signal with a positive value to the data line; and wherein the feedback compensation sub-circuit comprises a first resistor, a second resistor, a feedback resistor, a first comparator, a second comparator and a third storage capacitor;

a first terminal of the first resistor is coupled to the second terminal of the light emitting device and a positive input terminal of the first comparator, and a second terminal of the first resistor is coupled to a ground electrode;

a negative input terminal of the first comparator is coupled to a second terminal of the third storage capacitor and an output terminal of the second comparator; and output terminal of the first comparator is coupled to a positive input terminal of the second comparator;

a first terminal of the second resistor is coupled to a negative input terminal of the second comparator, and a second terminal of the second resistor is supplied with the power supply voltage;

a first terminal of the feedback resistor is coupled to the output terminal of the second comparator, and a second terminal of the feedback resistor is coupled to the negative input terminal of the second comparator; and a first terminal of the third storage capacitor is coupled to a data line, and is configured to store the data voltage compensation signal and provide it to the data line.

2. The pixel circuit according to claim 1, wherein the initialization sub-circuit comprises a second transistor; and a first electrode of the second transistor is supplied with the reference voltage, a second electrode of the second transistor is coupled to the control electrode of the driving transistor, and a control electrode of the second transistor is supplied with the enable signal.

3. The pixel circuit according to claim 1, wherein the threshold voltage extraction sub-circuit comprises a fourth transistor, a first storage capacitor and a second storage capacitor;

a first electrode of the fourth transistor is coupled to a first terminal of the first storage capacitor, a second electrode of the fourth transistor is coupled to a first terminal of the light emitting device, and a control electrode of the fourth transistor is supplied with the enable signal;

a second terminal of the first storage capacitor is coupled to the control electrode of the driving transistor; and a first terminal of the second storage capacitor is coupled to the first terminal of the first storage capacitor, and a second terminal of the second storage capacitor is supplied with the reference voltage.

4. The pixel circuit according to claim 3, wherein the switching sub-circuit comprises a third transistor; and a first electrode of the third transistor is coupled to the data line, a second electrode of the third transistor is coupled to the first terminal of the first storage capacitor, and a control electrode of the third transistor is supplied with the scan signal.

5. The pixel circuit according to claim 4, further comprising a de-noising sub-circuit;

wherein the de-noising sub-circuit is coupled to a reset signal terminal and a ground terminal and is configured to input a ground voltage to the first terminal of the light emitting device to de-noise a potential of the first terminal of the light emitting device under a control of a reset signal input by the reset signal terminal.

6. The pixel circuit according to claim 5, wherein the de-noising sub-circuit comprises a fifth transistor; and a first electrode of the fifth transistor is coupled to the first terminal of the light emitting device, a second electrode of the fifth transistor is coupled to the ground electrode, and a control electrode of the fifth transistor is coupled to the reset signal terminal.

7. The pixel circuit according to claim 6, wherein an impedance of the fifth transistor is greater than an impedance of the driving transistor.

8. The pixel circuit according to claim 5, wherein the de-noising sub-circuit comprises a fifth transistor; and a first electrode of the fifth transistor is coupled to the first terminal of the light emitting device, a second electrode of the fifth transistor is coupled to the ground electrode, and a control electrode of the fifth transistor is supplied with the enable signal.

9. The pixel circuit according to claim 8, wherein an impedance of the fifth transistor is greater than an impedance of the driving transistor.

10. A display device, comprising the pixel circuit of claim 1.

11. A driving method for a pixel circuit of claim 1, the driving method comprises:

in an initialization stage, inputting, by the initialization sub-circuit, a reference voltage to a control electrode of the driving transistor in response to an enable signal such that a first terminal of the light emitting device is discharged by the driving transistor;

in a threshold voltage extraction stage, extracting and storing, by the threshold voltage extraction sub-circuit, a threshold voltage of the driving transistor in response to the enable signal;

in a data writing stage, inputting, by the switching sub-circuit, a data voltage provided by a data line, to the threshold voltage extraction sub-circuit in response to a scan signal such that the threshold voltage extraction sub-circuit applies the threshold voltage of the driving transistor and the data voltage input by the switching sub-circuit to the control electrode of the driving transistor; and in a display stage, inputting, by the driving transistor, the data voltage to the light emitting device in response to the threshold voltage of the switching transistor and the data voltage, and generating, by the feedback compensation sub-circuit, a data voltage compensation signal for a next display image frame according to an operating current flowing through the light emitting device and providing, by the feedback compensation sub-circuit, the generated data voltage compensation signal to the data line; and the driving method further comprises determining, by the feedback compensation sub-circuit, whether the operating current of the light emitting device changes, wherein in response to the operating current of the light emitting device increasing, the feedback compensation sub-circuit outputs the data voltage compensation signal with a negative value to the data line; and in response to the operating current of the light emitting device decreasing, the feedback compensation sub-circuit outputs the data voltage compensation signal with a positive value to the data line.

12. The driving method for the pixel circuit according to claim 11, wherein the pixel circuit further comprises a de-noising sub-circuit, and the driving method further comprises: in the initialization stage, inputting, by the de-noising sub-circuit, a ground voltage to the light emitting device in response to a reset signal.

13. The driving method for the pixel circuit according to claim 12, wherein an impedance of the de-noising sub-circuit is greater than an impedance of the driving transistor.

14. The driving method for the pixel circuit according to claim 11, wherein the pixel circuit further comprises a de-noising sub-circuit, and the driving method further comprises: in the initialization stage, inputting, by the de-noising sub-circuit, a ground voltage to the light emitting device in response to the enable signal.

15. The driving method for the pixel circuit according to claim 14, wherein an impedance of the de-noising sub-circuit is greater than an impedance of the driving transistor.

* * * * *